US006102058A

United States Patent [19]

You

[11] Patent Number: 6,102,058

[45] Date of Patent: Aug. 15, 2000

[54] PIVOTAL COUPLING DEVICE FOR COLLAPSIBLE FRAME STRUCTURE OF SELF-OPENING UMBRELLA

[76] Inventor: Ching-Chuan You, 5F. No. 144, Ming Chuan E. Rd., Sec. 3, Taipei, Taiwan

[21] Appl. No.: 09/100,865

[22] Filed: Jun. 22, 1998

[30] Foreign Application Priority Data

Apr. 24, 1998 [TW] Taiwan ..... 87206353

[51] Int. Cl.[7] ..... A45B 25/00

[52] U.S. Cl. ..... 135/29; 135/32

[58] Field of Search ..... 135/22–24, 29–32, 135/37, 38

[56] References Cited

U.S. PATENT DOCUMENTS 5,372,155 12/1994 You ..... 135/29
5,715,853 2/1998 Lin ..... 135/29
5,746,235 5/1998 Lin ..... 135/29

*Primary Examiner*—Beth A. Aubrey

[57] ABSTRACT

A pivotal-coupling device is provided for a collapsible umbrella frame structure, which allows the pivotal coupling between the main shaft and the framing rib to be achieved without having to use supersonic wave bonder, thus making the assembly work more easy to carry out and the manufacturing cost reduced. It also allows the assembly work to be carried out manually without having to use machine tools or welding means. The pivotal-coupling device includes a first linking member affixed to the main shaft; a second linking member affixed to the framing rib, and a pivotal pin for providing a pivotal coupling of the first linking member to the second linking member, allowing the main shaft to be pivotally coupled to the framing rib. Compared to the prior art, this pivotal-coupling device is considerably simpler in structure that allows it to be formed easily through machining and further allows the assembly work to be easily carry out by hand without having to use machine tools or welding means.

3 Claims, 4 Drawing Sheets

PIVOTAL COUPLING DEVICE FOR COLLAPSIBLE FRAME STRUCTURE OF SELF-OPENING UMBRELLA

BACKGROUND OF THE INVENTION

1. Field of the Invention

This invention relates to umbrellas, and more particularly, to a pivotal-coupling device for the collapsible frame structure of a self-opening umbrella for use to pivotally couple each of the framing ribs of the collapsible frame structure to the main shaft of the umbrella.

2. Description of Related Art

A collapsible umbrella (also called a foldable umbrella) allows the user to collapse the umbrella when the umbrella is not in use for easy storage or carriage. Collapsible umbrellas are typically provided with a self-opening mechanism that allows the umbrella, after being collapsed, to be opened automatically without manual effort from the user. A collapsible frame structure typically includes a frame of ribs that are coupled in a pivotable manner to the main shaft so as to allow the umbrella frame to be collapsible. A conventional pivotal-coupling device for collapsible umbrella frame structure is illustratively described in the following with reference to FIGS. 4–6.

As shown in FIGS. 4–6, the conventional pivotal-coupling device for collapsible umbrella frame structure includes a first linking member 30 affixed to the main shaft 10 of the umbrella, and a second linking member 40 affixed to one end of one framing rib 20 of the collapsible umbrella frame structure. The first linking member 30 can be pivotally coupled to the second linking member 40, thereby allowing the main shaft 10 to be pivotally coupled to the framing rib 20. The first linking member 30 includes a substantially U-shaped body 31; a pair of tubular members 32, 33 having a through hollowed inside 330, 320 allowing the main shaft 10 to insert therein; and a coupling hole 35 for pivotal coupling with the second linking member 40. Further, the first linking member 30 is formed with a pair of applying surface 321, 331 where supersonic wave bonding process can be applied so as to help secure the first linking member 30 to the main shaft 10. The second linking member 40 includes a body portion 41, a tubular portion 42, a fixed ear 43A, a bendable locking ear 43B, and a pivotal pin 44. The tubular portion 42 has a bore that allows the framing rib 20 to insert therein and fixed in position by also applying supersonic wave bonding process on the applying portion 421.

As shown in FIG. 5, during assembly, the first linking member 30 is first coupled to the second linking member 40 in such a manner that the pivotal pin 44 on the second linking member 40 passes through the coupling hole 35 in the first linking member 30. After this, as shown in FIG. 6, the bendable locking ear 43B is bent upwards to allow the hole 432 in the locking ear 43B to be coupled to the free end 441 of the pivotal pin 44. After this, the free end 441 of the pivotal pin 44 is melted by using, for example, supersonic wave bonder, into an enlarged end 441A that can help secure the locking ear 43B tightly in position. This completes the coupling of the main shaft 10 to the framing rib 20. As illustrated in FIG. 6, the main shaft 10 is pivotally about the pivotal pin 44 of the second linking member 40.

One drawback to the foregoing pivotal-coupling device, however, is that it requires the use of supersonic wave bonder to complete the pivotal coupling of the main shaft 10 to the framing rib 20, which makes the assembly work quite costly to carry out. Moreover, the forming of the bendable locking ear 43B and the hole 432 therein is quite difficult in machining, and the hole 432 can hardly be aligned precisely with the pivotal pin 44. The resultant pivotal-coupling device is therefore occasionally poor in quality that can easily break apart.

SUMMARY OF THE INVENTION

It is therefore an objective of the present invention to provide a pivotal-coupling device for a collapsible umbrella frame structure, which allows the pivotal coupling between the main shaft and the framing rib to be achieved without having to use supersonic wave bonder, so as to make the assembly work more easy and to reduce the manufacturing cost of the umbrella.

It is another objective of the present invention to provide a pivotal-coupling device for a collapsible umbrella frame structure, which allow the assembly work to be carried out manually without having to use machine tools or bonder.

In accordance with the foregoing and other objectives of the present invention, an improved pivotal-coupling device is provided for a collapsible umbrella frame structure. The pivotal-coupling device of the invention is used for pivotally coupling the main shaft of the umbrella to each framing rib. The pivotal-coupling device of the invention includes the following constituent parts:

- a first linking member affixed to the main shaft, the first linking member being formed with a coupling hole;
- a second linking member affixed to the framing rib, the second linking member being formed with a pair of ears between which a body portion is defined, with each of the ears being formed with a through hole therein; and
- a pivotal pin having a rear head, an elongated portion, and a front tapered head; the front and rear heads being larger in diameter than the elongated portion.

In assembly, the coupling hole of the first linking member is disposed in the body portion between the ears of the second linking member, and then the pivotal pin is inserted with its front tapered head through the holes in the ears and the coupling hole in the second liking member and locked at the holdes of the ears so as to pivotally couple the first linking member to the second linking member, allowing the main shaft to be pivotally coupled to the framing rib.

Compared to the prior art, the pivotal-coupling device of the invention is considerably simpler in structure that allows it to be formed easily through machining and further allows the assembly work to be easily carry out by hand without having to use machine tools or bonding means.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

Figure 1:
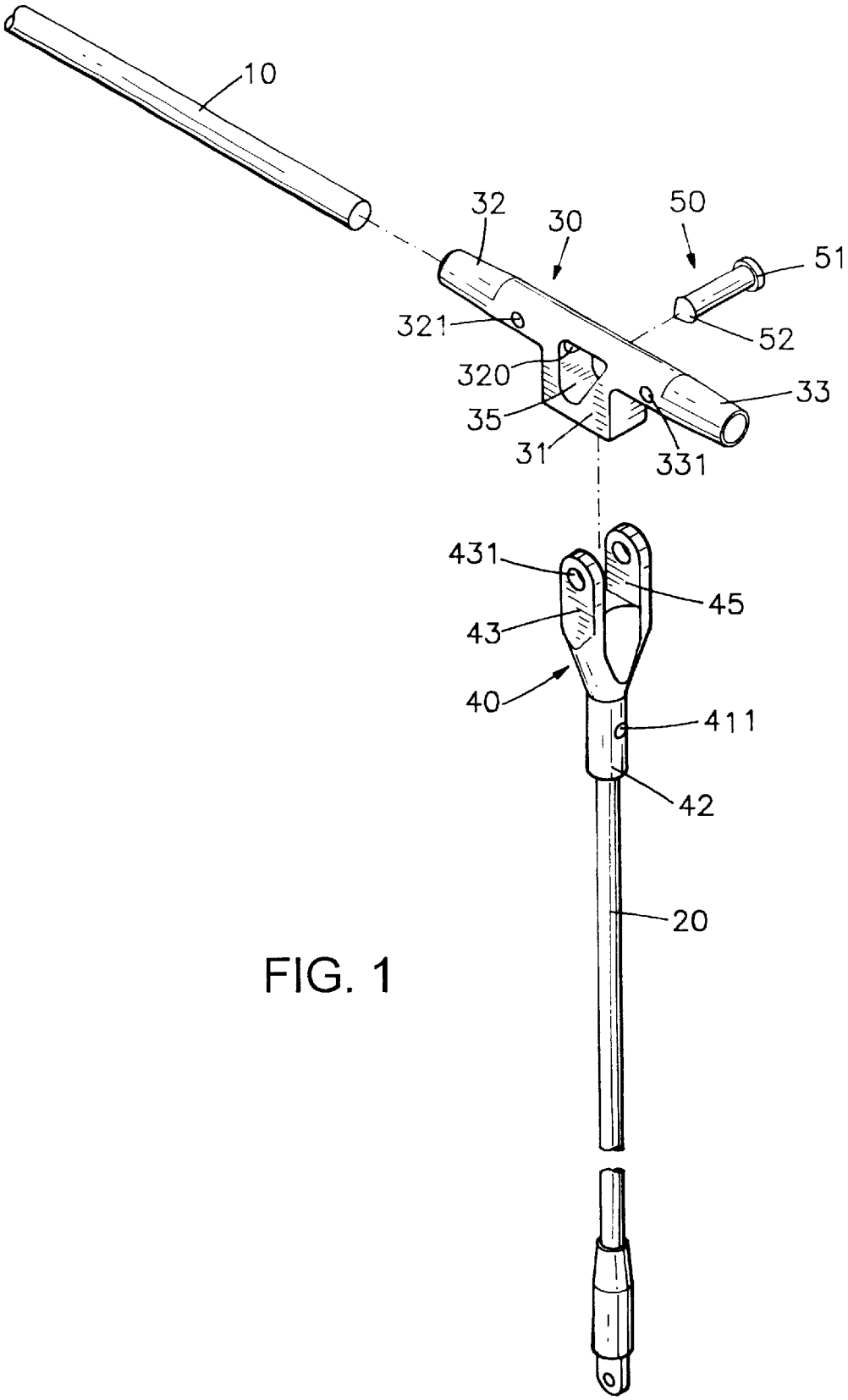
FIG. 1 is an exploded perspective view of the pivotal-coupling device of the invention for collapsible umbrella frame structure.
Figure 2:
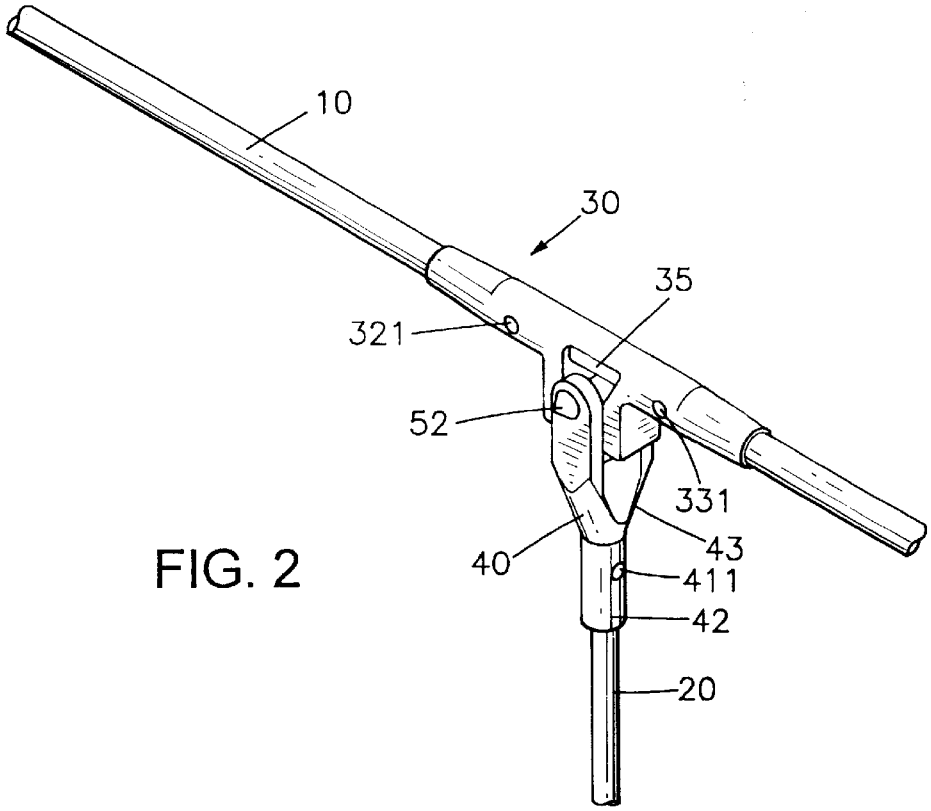
FIG. 2 is perspective view of the pivotal-coupling device of FIG. 1 when assembled.
Figure 3:
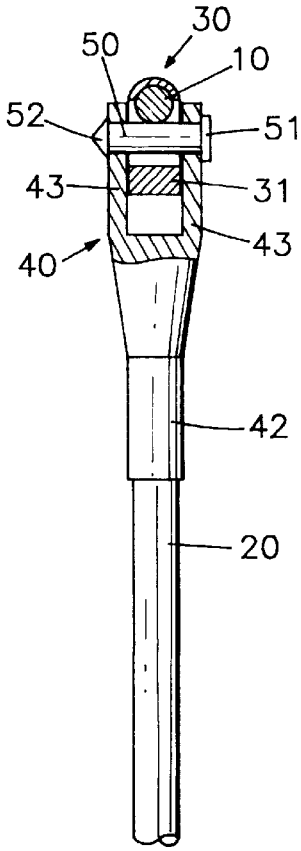
FIG. 3 is a cross-sectional view of the pivotal-coupling device of FIG. 2.

A preferred embodiment of the pivotal-coupling device according to the invention is illustrated in FIGS. 1–3. This pivotal-coupling device is used for pivotally coupling a main shaft 10 to a framing rib 20 of the umbrella, which includes mainly a first linking member 30 affixed to the main shaft 10 and a second linking member 40 affixed to the framing rib 20.

Figure 4:
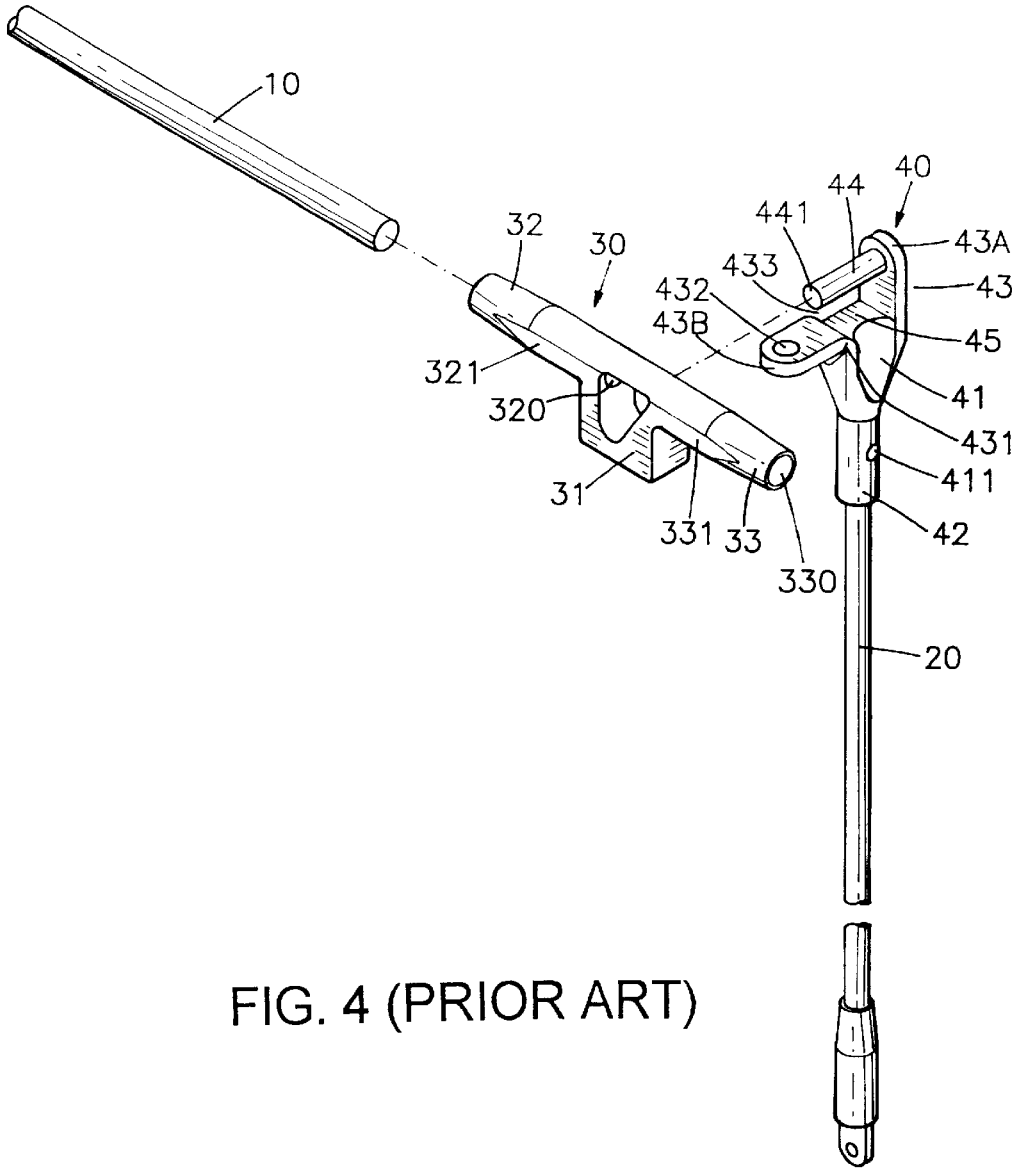
FIG. 4 (PRIOR ART)
FIG. 4 is an exploded perspective view of a conventional pivotal-coupling device for collapsible umbrella frame structure.
Figure 5:
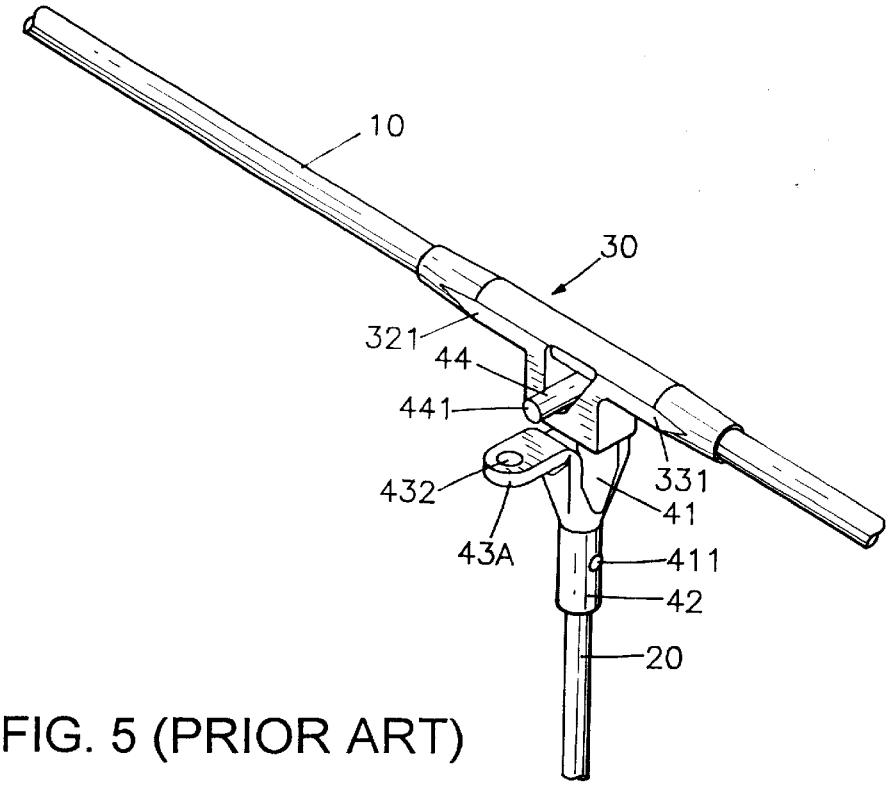
FIG. 5 (PRIOR ART)
FIG. 5 is a perspective view of the pivotal-coupling device of FIG. 4 at one step during the assembly.
Figure 6:
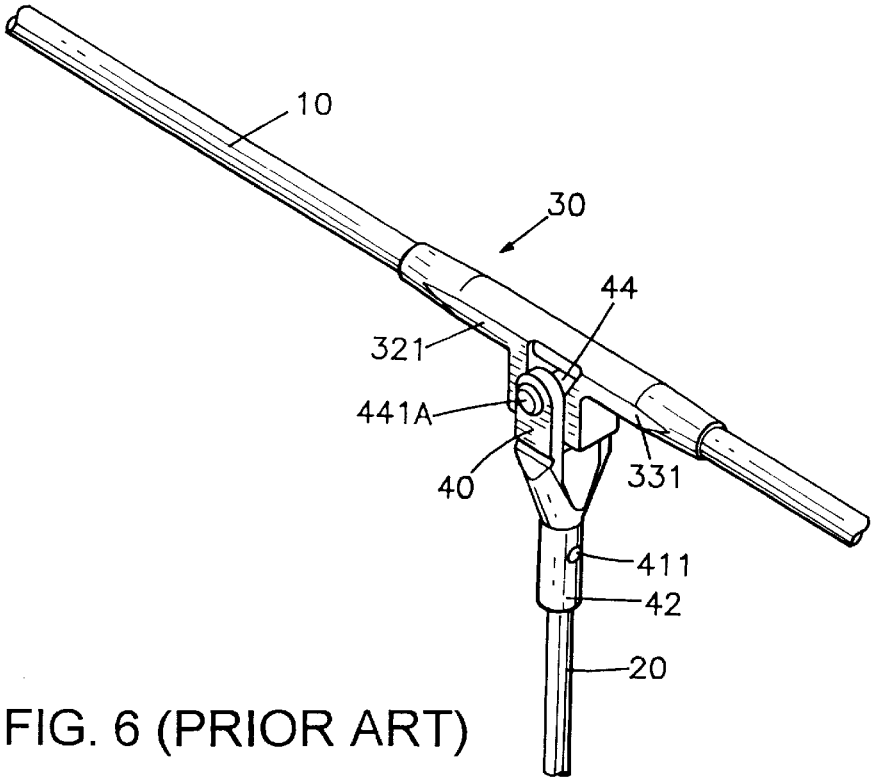
FIG. 6 (PRIOR ART)
FIG. 6 is a perspective view of the pivotal-coupling device of FIG. 4 when completely assembled.

The first linking member 30 includes a substantially U-shaped body 31; a pair of tubular members 32, 33 having a hollowed inside for coupling with the main shaft 10; a coupling hole 35 for pivotal coupling with the second linking member 40. Further, the first linking member 30 is formed with a pair of holes 321, 331 where adhesive can be filled so as to help secure the first linking member 30 to the main shaft 10. The first linking member 30 shown here is substantially identical in structure with that shown in FIGS. 4–6 for the prior art.

The second linking member 40 is formed with a tubular portion 42 and a pair of ears 43, 43. Similar to the prior art, the tubular portion 42 has a bore that allows the framing rib 20 to insert therein and then fix in position by applying adhesive through the hole 411. It is a characteristic feature of the invention in comparison with the prior art that both the ears 43, 43 here are fixed portions of the second linking member 40. Between the ears 43, 43 is there formed with a body portion 45. Each of the ears 43, 43 is formed with a hole 431 for a pivotal pin 50 to pass therethrough. The pin 50 is formed with a head 51 at the rear end and a tapered head portion 52 at the front end, with the head 51 and the tapered head portion 52 slightly larger in diameter than the elongated portion of the pin 50.

As shown in FIGS. 2 and 3, in assembly, the main shaft 10 is first affixed to the first linking member 30; then the U-shaped body 31 is disposed in the body portion 45 between the ears 43, 43 of the second linking member 40; and then the pin 50 is inserted successively through the hole 431 in the right ear 43 of the second linking member 40, the coupling hole 35 in the first linking member 30, and the hole 431 in the left ear 43 of the second linking member 40 with its front tapered head portion 52 and locked at the hole 431 in the left ear 43, as shown in FIGS. 2 and 3. This completes the pivotal coupling of the main shaft 10 to the framing rib 20, allowing the framing rib 20 to be pivotable about the pivotal-coupling device of the invention on the main shaft 10.

It can be learned from the foregoing description that the pivotal-coupling device of the invention is considerably simpler in structure than the prior art that allows it to be formed easily through machining, and further the assembly work can be easily carry out by hand without having to use machine tools or welding means. The pivotal-coupling device of the invention is therefore more advantageous than the prior art.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A pivotal-coupling device for a collapsible umbrella frame to pivotally couple main shaft of the umbrella to framing rib, which comprises:

a first linking member affixed to the main shaft, the first linking member being a U-shaped body formed with a coupling hole;

a second linking member affixed to the framing rib, the second linking member being formed with a pair of a first and a second ears between which a body portion is defined, with each of the first and second ears being formed with a through hole therein; and a pivotal pin having a rear head, an elongated portion and a front tapered head, the front and rear heads being larger in diameter than the elongated portion;

in assembly, the coupling hole in the U-shaped body of the first linking member being disposed in the body portion between the first and second ears of the second linking member, and the pivotal pin being inserted with the front tapered head thereof through the hole in the first ear of the second linking member, the coupling hole in the first linking member and the hole in the second ear of the second leaking member and then locked at the hole in the second ear of the second linking member so as to pivotally couple the first linking member to the second linking member, allowing the main shaft to be pivotally coupled to the framing rib.

2. The pivotal-coupling device of claim 1, wherein the first linking member is formed with a tubular portion having a through bore which allows the main shaft to insert therein so as to affix the first linking member to the main shaft.

3. The pivotal-coupling device of claim 1, wherein the second linking member is formed with a tubular portion with a bore which allows one end of the framing rib to insert therein so as to affix the second linking member to one end of the framing rib.

* * * * *